US006416243B1

(12) United States Patent
Castro

(10) Patent No.: US 6,416,243 B1
(45) Date of Patent: Jul. 9, 2002

(54) KEEPSAKE SLEEVE

(76) Inventor: Carlos R. Castro, Apt. 27 A, The Village Green, Budd Lake, NJ (US) 07828

( * ) Notice: Subject to any disclaimer, the term of this patent is extended or adjusted under 35 U.S.C. 154(b) by 0 days.

(21) Appl. No.: 09/885,739

(22) Filed: Jun. 20, 2001

(51) Int. Cl.[7] ..... B42F 13/00

(52) U.S. Cl. ..... 402/73; 40/124.06; 229/67.1; 281/5; 283/62; 402/80 P; 462/8; D19/26

(58) Field of Search ..... 40/124.06; 281/2, 281/5, 15.1, 21.1, 23, 29, 31, 36, 37, 38; 283/61, 62; 402/70, 73, 75, 79, 80 R, 80 P; D19/26, 27, 33; 462/7, 8, 66, 68; 229/67.1, 67.2, 67.3, 67.4, 72

(56) References Cited

U.S. PATENT DOCUMENTS

| | | | | | |
|---|---|---|---|---|---|
| 2,190,438 | A | * | 2/1940 | Vogt | |
| 3,920,267 | A | * | 11/1975 | Lyon, Jr. | 281/16 |
| 4,629,349 | A | * | 12/1986 | Pitts | 281/31 |
| 4,830,404 | A | * | 5/1989 | Lu | 281/2 |
| 4,925,720 | A | * | 5/1990 | Hansen | 281/38 |
| D314,977 | S | * | 2/1991 | Wyant | D19/27 |
| 5,005,870 | A | * | 4/1991 | Desmouliere | 281/21.1 |
| 5,685,530 | A | * | 11/1997 | DeLise | 270/37 |
| 5,752,721 | A | * | 5/1998 | Balbas | 281/19.1 |
| 5,772,349 | A | | 6/1998 | Tubergen | 402/79 |
| 5,857,705 | A | * | 1/1999 | Dahlquist | 281/5 |
| 5,915,874 | A | * | 6/1999 | Wilson et al. | 402/79 |
| 5,997,043 | A | * | 12/1999 | Dahlquist | 283/63.1 |
| 6,003,254 | A | * | 12/1999 | Lorber | 40/124.06 |

* cited by examiner

*Primary Examiner*—A. L. Wellington
*Assistant Examiner*—Monica S. Carter
(74) *Attorney, Agent, or Firm*—Walter J. Tencza, Jr.

(57) ABSTRACT

The present invention discloses a apparatus which includes a left front panel and a left back panel which together form a first pocket and a right front panel and a right back panel which together form a second pocket. The apparatus also includes a left closing flap which is connected to the left back panel, a middle closing flap which is connected to the right back panel, a right closing flap which is connected to the middle closing flap. An item or items, such as a keepsake, can be inserted into the first and/or second pocket. The keepsake may be a greeting card and a portion or panel of the greeting card may be inserted into the first pocket while another portion or panel may be inserted into the second pocket. The first and second pockets are preferably virtually completely or completely sealed so that no the inserted keepsake can not be damaged. The left closing flap, the middle closing flap, and the right closing flap may each have a set of a plurality of holes. The sets can be aligned and rings of a binder can be placed through the aligned sets of holes. The left closing flap may fit between the middle closing flap and the right closing flap to form an interlocking flaps.

20 Claims, 5 Drawing Sheets

KEEPSAKE SLEEVE

FIELD OF THE INVENTION

This invention relates to improved methods and apparatus for retaining keepsakes such as greeting cards, diplomas, baseball cards, concert stubs, playbills, and photographs.

BACKGROUND OF THE INVENTION

Typically in the prior art plastic sleeves are used for retaining keepsakes or collector's items such as greeting cards, diplomas, baseball cards, and other items. However, such plastic sleeves typically do not provide a complete seal to protect the keepsakes.

U.S. Pat. No. 5,772,349 to Tubergen discloses a protective sleeve or jacket for displaying and storing a greeting card. (Tubergen, Abstract). In one embodiment Tubergen discloses that top edges 27 and 28 and bottom edges 29 and 30 are closed and that a card is inserted partially folded into the sleeve 20 at back opening 37. (Tubergen, col. 3, Ins. 25–30). However, Tubergen does not disclose a complete seal or a virtually complete seal. In Tubergen, either the top is open (near edges 27 and 28) or the bottom is open (near edges 29 and 30) or the back opening is open (near flaps 31). In any case, there will not be a complete seal. In addition, the flaps 31 shown in Tubergen FIG. 1, do not have an interlocking design.

SUMMARY OF THE INVENTION

The present invention in one embodiment discloses an apparatus or keepsake sleeve comprising a left front panel and a left back panel which together form a first pocket, a right front panel and a right back panel which together form a second pocket, a left closing flap which is connected to the left back panel, a middle closing flap which is connected to the right back panel; and a right closing flap which is connected to the middle closing flap. The first and/or second pockets can be used to hold keepsakes such as a greeting card. In one embodiment a first portion or panel of a greeting card is inserted into the first pocket and a second portion or panel is inserted into the second pocket. The first and second pockets are substantially sealed. The left closing flap may fit in between the right and middle closing flaps to provide interlocking flaps for better sealing and better strength for the sleeve.

The left, middle, and right closing flaps may each have a set of a plurality of holes. Each flap may have three holes. The holes of the flaps may be aligned and rings of a binder inserted through the aligned holes.

The present invention also includes a method for constructing or forming a sleeve which is capable of providing a virtually complete or complete seal for keepsakes such as greeting cards. The method may include forming first and second pockets and inserting a portion of a keepsake into the first pocket and a portion into the second pocket. The method may also include inserting the left closing flap in between the middle and right closing flaps, aligning corresponding sets of holes on the left, middle and right closing flaps, and inserting a binder ring into each combination of holes from the left, middle, and right closing flaps.

DETAILED DESCRIPTION OF THE DRAWINGS

Figure 1:
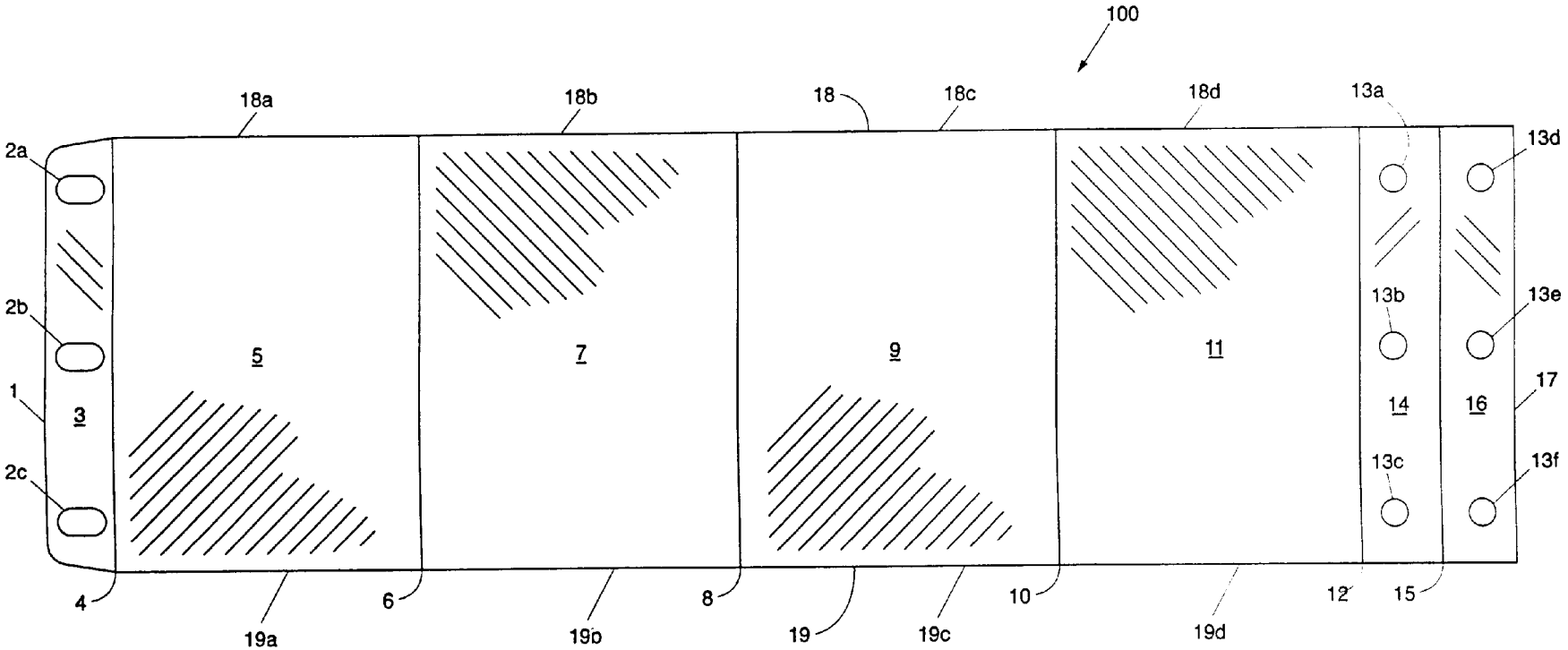
FIG. 1 shows a side view of a keepsake sleeve in accordance with an embodiment of the present invention in a fully extended laid out format.

FIG. 1 shows a side view of a keepsake sleeve 100 in accordance with an embodiment of the present invention in a fully extended laid out format. The keepsake sleeve 100 includes left closing flap 3, left/back panel 5, left/front panel 7, right/front panel 9, right/back panel 11, middle closing flap 14, and right closing flap 16.

The left closing flap 3 has three elongated punch holes 2*a*, 2*b*, and 2*c*. The three elongated punch holes 2*a*–2*c* can be located so that the left closing flap 3 can be placed in a standard three ring binder, with the first ring going through hole 2*a*, the second ring through hole 2*b* and the third ring through hole 2*c*. The middle closing flap 14 and the right closing flap 16 each have three holes 13*a–c* and 13*d–f* respectively. The three punch holes 13*a*–13*c* can be located so that the middle closing flap 14 can be placed in a standard three ring binder, with the first ring going through hole 13*a*, the second ring through hole 13*b* and the third ring through hole 13*c*. The three punch holes 13*d*–13*f* can be located so that the right closing flap 16 can be placed in a standard three ring binder, with the first ring going through hole 13*d*, the second ring through hole 13*e* and the third ring through hole 13*f*.

The left closing flap 3, left/back panel 5, left/front panel 7, right/front panel 9, right/back panel 11, middle closing flap 14, and right closing flap 16 can be made of plastic. The plastic may be any thickness depending on the keepsake to be stored. A greater thickness may be provided for better protection for the particular keepsake.

The keepsake sleeve 100 has a left edge 1, a top edge 18, a bottom edge 19, and a right edge 17. The top edge 18 is comprised of portions 18*a*, 18*b*, 18*c*, and 18*d*. The bottom edge 19 is comprised of portions 19*a*, 19*b*, 19*c*, and 19*d*. The keepsake sleeve 100 also has a first fold line 4, a second fold line 6, a third fold line 8, a fourth fold line 10, a fifth fold line 12, and a sixth fold line 15.

Figure 2:
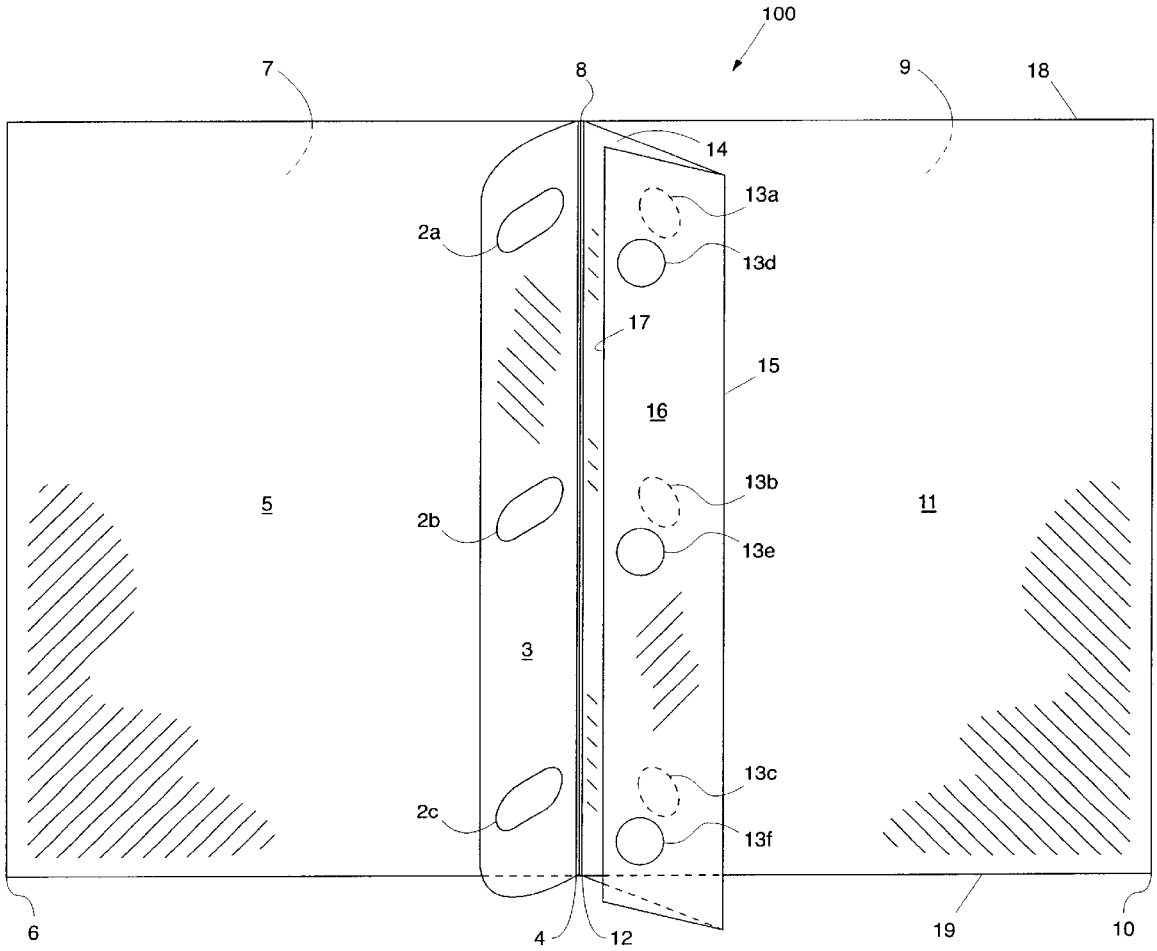
FIG. 2 shows a side view of the keepsake sleeve of FIG. 1 with various panels of the keepsake sleeve folded over to form two pockets.
Figure 5:
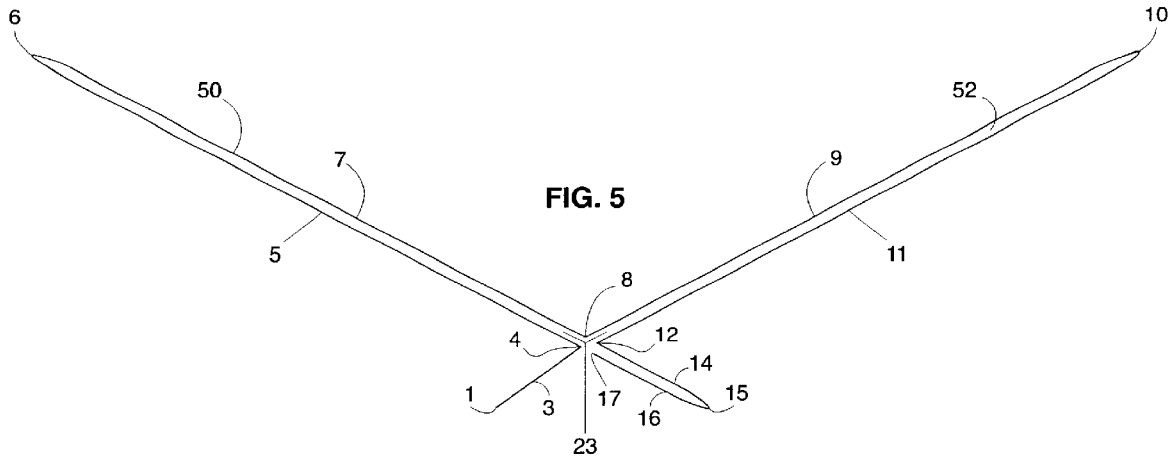
FIG. 5 shows a top view of the keepsake sleeve of FIG. 1 with the various panels of the keepsake sleeve folded over as in FIG. 2.

FIG. 2 shows a side rear view of the keepsake sleeve 100 of FIG. 1 with various panels of the keepsake sleeve 100 folded over to form two pockets 50 and 52. In FIG. 2, left/back panel 5 has been folded over and is now on top of left/front panel 7. Left/front panel 7 has been identified by a dashed line in FIG. 2. Right/back panel 11 has been folded over and is now on top of right/front panel 9. Right/front panel 9 has been identified by a dashed line in FIG. 2. The top edge 18 and the bottom edge 19 can be sealed. By the steps of folding the appropriate panel on top of its counterpart to go from FIG. 1 to FIG. 2 and sealing the top edge 18 and the bottom edge 19, two pockets are formed. The first pocket 50, as shown in FIG. 5, lies between left/back panel 5 and left/front panel 7. The second pocket 52, as shown in FIG. 5, lies between right/back panel 11 and right/front panel 9. Portions 18*a* and 18*b* are sealed together, and portions 19*a* and 19*b* are sealed together to form the first pocket. Portions 18*c* and 18*d* are sealed together and portions 19*c* and 19*d* are sealed together to form the second pocket.

Figure 3:
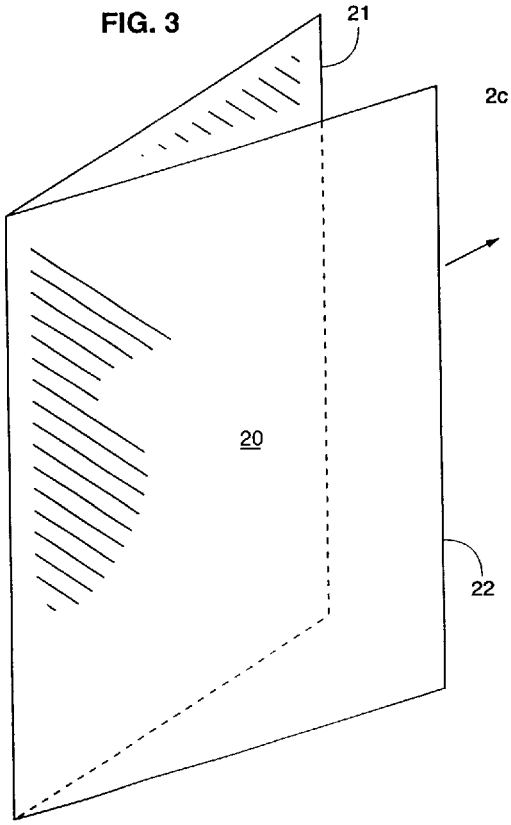
FIG. 3 shows a perspective view of a keepsake for insertion into the keepsake sleeve of FIG. 2.

FIG. 3 shows a perspective view of a keepsake 20, which in this case may be a greeting card. The keepsake 20 has a left edge 21 and a right edge 22.

Figure 4:
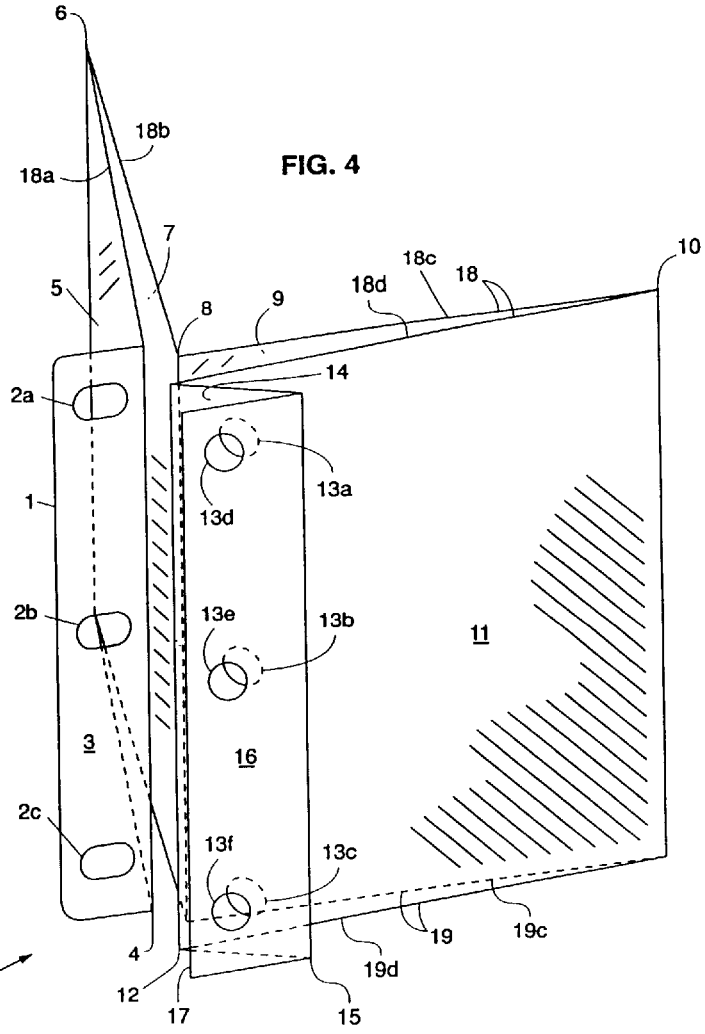
FIG. 4 shows a perspective view the keep sake sleeve of FIG. 1 with various panels of the keepsake sleeve folded over similar to FIG. 2.

FIG. 4 shows a perspective view the keep sake sleeve 100 of FIG. 1 with the various panels of the keepsake sleeve 100 folded over similar to FIG. 2. However the portions 18*c* and 18*d*, portions 19*c* and 19*d*, portions 18*a* and 18*b*, and portions 18*c* and 18*d* are not yet shown sealed together in FIG. 4.

FIG. 5 shows a top view of the keepsake sleeve 100 of FIG. 1 with the various panels of the keepsake sleeve 100 folded over similar to FIG. 2.

Figure 6:
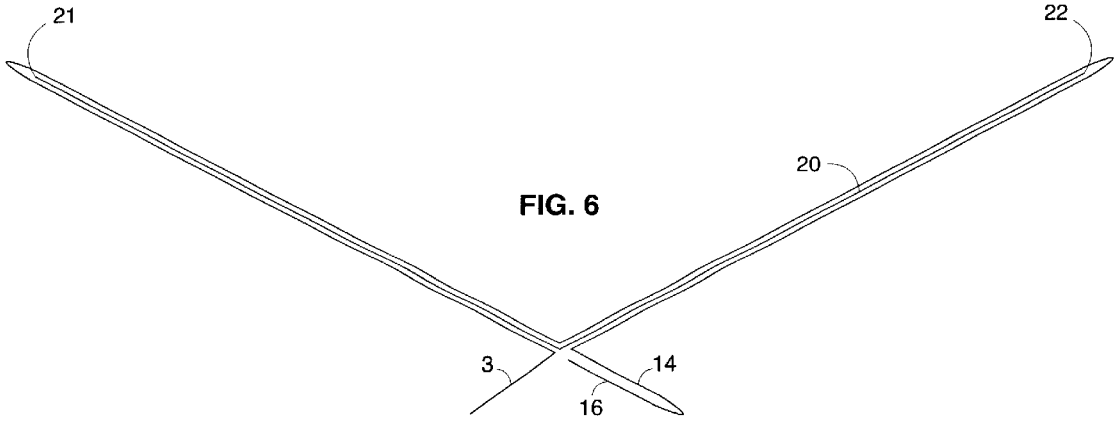
FIG. 6 shows a top view of the keepsake sleeve as in FIG. 5 with a keepsake inserted into the keepsake sleeve.

FIG. 6 shows a top view of the keepsake sleeve 100 as in FIG. 5 but with the keepsake 20 inserted into the keepsake sleeve 100.

Figure 7:
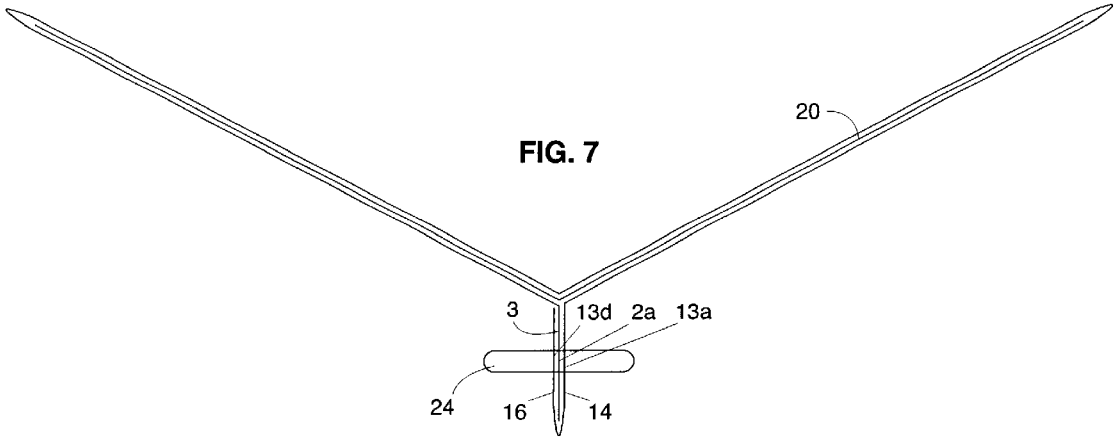
FIG. 7 shows a top view of the keepsake sleeve similar to FIG. 6 except that flaps of the keepsake have been brought together and a binder ring inserted through the flaps.

FIG. 7 shows a top view of the keepsake sleeve 100 similar to FIG. 5 except that flaps 3, 14, and 16 of the keepsake sleeve 100 have been brought together and a binder ring 24 inserted through the flaps 13, 14, and 16.

Figure 8:
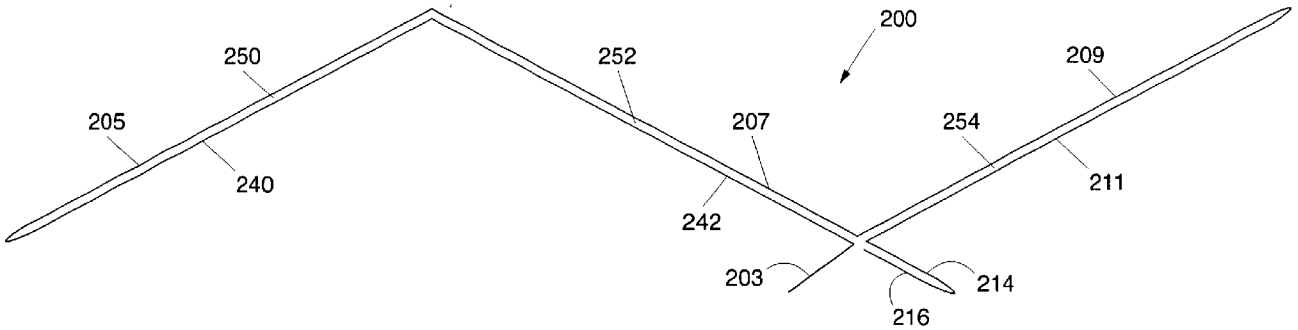
FIG. 8 shows a top view of a keepsake sleeve in a folded over format in accordance with a second embodiment of the present invention where three pockets are formed.
Figure 9:
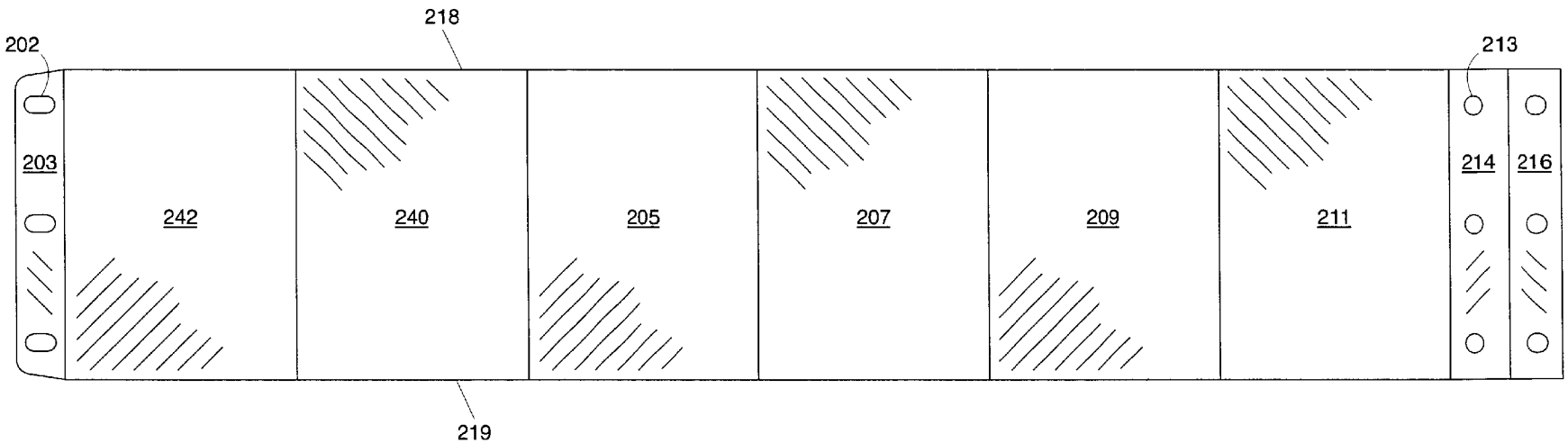
FIG. 9 shows a side view of the keepsake sleeve of FIG. 8 with the keepsake sleeve in a flat fully extended format.

FIG. 8 shows a top view of a keepsake sleeve 200 in a folded over format in accordance with a second embodiment of the present invention where three pockets 250, 252, and 254 are formed. FIG. 9 shows a side view of the keepsake sleeve 200 of FIG. 8 with the keepsake sleeve 200 in a flat fully extended format. The keepsake sleeve 200 includes panels 242, 240, 205, 207, 209, and 211 and flaps 203, 214, and 216. In the folded over format of FIG. 8, panel 240 is lies on top of panel 205, panel 242 lies on top of panel 207 and panel 211 lies on top of panel 209. The panels which lies on top of each other in FIG. 8 can be sealed together along a top edge 218 and along a bottom edge 219 similar to keepsake sleeve 100 of FIG. 2. Flap 203 may have three holes 202, flap 214 may have three holes 213 and flap 216 may have three holes 213 similar to the punch holes described for keepsake sleeve 100. Further embodiments have a greater number of panels and thus a greater number of pockets can be provided.

The method for constructing the keepsake sleeve 100, and placing it in its folded up form suitable for inserting keepsakes, and the method for inserting a keepsake into keepsake sleeve 100 will be now be described. Keepsake sleeve 100 may initially be a single, continues, flexible sheet of plastic. Holes 2*a*–2*c* and 13*a*–*f* may be created by punching holes through a uniform sheet of plastic. Folds 4, 6, 8, 10, 12, and 15 may be created by appropriately folding the keepsake sleeve 100 or in any other known manner. With the keepsake sleeve 100 in the laid out fully extended format of FIG. 1, an individual can fold the sleeve 100 so that panel 5 lies on top of panel 7 and panel 11 lies on top of panel 9 as shown by FIGS. 2 and 5. The individual can then seal the edge portions 18*a* and 18*b* together, the edge portions 19*a* and 19*b* together, the edge portions 18*c* and 18*d* together, and the edge portions 19*c* and 19*d* together. This forms the pockets 50 and 52 shown in FIG. 5.

A person may then insert a keepsake 20 into the pockets 50 and 52 as shown in FIG. 6. The person may then place flap 3 between flaps 14 and 16. The holes 2*a*–*c* should at that point be aligned with the holes 13*a*–*c* and the holes 13*d*–*f*, respectively. The sleeve 100 then can be placed in a standard three ring binder by inserting the first ring into the combination of holes 2*a*, 13*a*, and 13*d*, the second ring into the combination of holes 2*b*, 13*b*, and 13*e*, and the third ring into the combination of holes 2*c*, 13*c*, and 13*f*. Ring 24 is shown inserted through holes 2*a*, 23*a*, and 13*d* in FIG. 7.

The keepsake sleeve of embodiments of the present invention provides better protection for keepsakes than sleeves of the prior art. Unlike the prior art, the keepsake sleeve of the present invention provides a virtually complete or complete seal. As applied to keepsakes, such as greeting cards, the seal will prevent people from constantly pulling greeting cards in and out, which can lead to wear and tear on the greeting cards. The seal will prevent finger prints from getting on the greeting cards and will greatly limit the amount of dust, smudges and dirt from getting on the cards and in the sleeve.

In at least one embodiment, elongated punch holes provide for smoother opening of a three ring binder in which the keepsake sleeve or sleeves can be stored. The keepsake sleeve can be made with more than two pockets and still employ the interlocking flaps of the present invention.

The keepsake sleeves can be stored loose or in a binder. The left closing flap 3, middle closing flap 14, and right closing flap 16 provide an interlocking function or virtual seal when closed in the position shown in FIG. 7. The left closing flap 3 can be inserted between the middle closing flap 14 and the right closing flap 16 into the position shown in FIG. 7 without the binder ring 24. In this matter the keepsake sleeve 100 can also be stored loosely, i.e. without binder rings, and still have the interlocking or virtual seal function.

If the keepsake sleeve 100 is inserted into a binder, the left closing flap 3 prevents the keepsake 20 from contacting the binder ring 24 as shown by FIGS. 7 and FIG. 1. In contrast in prior art devices, the spine of the keepsake, such as the spine of a greeting card, would slide and contact binder rings, and this would cause wear and tear to the spine of the greeting card.

The size of the plastic sleeve, such as sleeves 100 or 200, may vary. The size, for example of the panels (5, 7, 9, and 11) of sleeve 100, can each be eight and one-half inches in width across the edges 18 and 19, and eleven inches in length. I.e. each panel can be eight and one-half inches by eleven inches, however, however the panels may go from the size of a baseball card to much larger. Each panel may have a thickness of typical plastic sheets and the thickness may vary.

The keepsake sleeves 100 or 200 can be plastic but other types of material can be used. Clear plastic is preferred for sleeves 100 and 200. Also a material that is easy to clean and that one can write on can be used.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a left front panel and a left back panel which together form a first pocket;

a right front panel and a right back panel which together form a second pocket;

a left closing flap which is connected to the left back panel;

a middle closing flap which is connected to the right back panel; and a right closing flap which is connected to the middle closing flap;

wherein the left front panel, the left back panel, the right front panel, and the right back panel each have a bottom edge portion and a top edge portion;

wherein the bottom edge portions of the left front panel and the left back panel are sealed together and the top edge portions of the left front panel and the left back panel are sealed together to form the first pocket;

and wherein the bottom edge portions of the right front panel and the right back panel are sealed together and the top edge portions of the right front panel and the right back panel are sealed together to form the second pocket.

2. An apparatus comprising:

a left front panel and a left back panel which together form a first pocket;

a right front panel and a right back panel which together form a second pocket;

a left closing flap which is connected to the left back panel;

a middle closing flap which is connected to the right back panel; and a right closing flap which is connected to the middle closing flap;

wherein the left closing flap has a first set of a plurality of holes;

the middle closing flap has a second set of a plurality of holes;

and the right closing flap has a third set of a plurality of holes.

3. The apparatus of claim 2 wherein each set of a plurality of holes includes three holes spaced apart so that each of the left closing flap, the middle closing flap, and the right closing flap can fit into a standard three ring binder.

4. An apparatus comprising:

a left front panel and a left back panel which together form a first pocket;

a right front panel and a right back panel which together form a second pocket;

a left closing flap which is connected to the left back panel;

a middle closing flap which is connected to the right back panel; and a right closing flap which is connected to the middle closing flap;

wherein the left closing flap fits between the middle closing flap and the right closing flap.

5. The apparatus of claim 2 wherein the left closing flap fits between the middle closing flap and the right closing flap.

6. The apparatus of claim 3 wherein the left closing flap fits between the middle closing flap and the right closing flap.

7. The apparatus of claim 5 wherein the left closing flap can be fit between the middle closing flap and the right closing flap in a first position where each hole of the first set of a plurality of holes lines can be aligned with a hole of the second set of the plurality of holes and a hole of the third set of the plurality of holes.

8. The apparatus of claim 6 wherein the left closing flap can be fit between the middle closing flap and the right closing flap in a first position where each hole of the first set of a plurality of holes lines can be aligned with a hole of the second set of the plurality of holes and a hole of the third set of the plurality of holes.

9. The apparatus of claim 7 wherein each hole of the first set of a plurality of holes is slightly larger than each hole of the second and third sets of a plurality of holes.

10. The apparatus of claim 8 wherein each hole of the first set of a plurality of holes is slightly larger than each hole of the second and third sets of a plurality of holes.

11. The apparatus of claim 1 wherein the left front panel, the left back panel, the right front panel, the right back panel, the left left closing flap, the middle closing flap and the right closing flap are all part of a continuous sheet.

12. The apparatus of claim 11 wherein the continuous sheet is made of plastic.

13. The apparatus of claim 1 wherein the left back panel and the left front panel each have a top edge portion and a bottom edge portion;

the top edge portions of the left back panel and the left front panel are connected together and the bottom edge portions of the left back panel and the left front panel are connected together;

the right back panel and the right front panel each have a top edge portion and a bottom edge portion; and the top edge portions of the right back panel and the right front panel are connected together and the bottom edge portions of the right back panel and the right front panel are connected together.

14. A method of forming a keepsake sleeve comprising the steps of forming a first pocket comprised of a left front panel and a left back panel;

forming a second pocket comprised of a right front panel and a right back panel;

forming a left closing flap which is connected to the left back panel;

forming a middle closing flap which is connected to the right back panel; and forming a right closing flap which is connected to the middle closing flap; and wherein the left front panel, the left back panel, the right front panel, and the right back panel each have a bottom edge portion and a top edge portion;

wherein the step of forming the first pocket includes sealing together the bottom edge portions of the left front panel and the left back panel and sealing together the top edge portions of the left front panel and the left back panel;

and wherein the step of forming the second pocket includes sealing together the bottom edge portions of the right front panel and the right back panel and sealing together the top edge portions of the right front panel and the right back panel.

15. A method of forming a keepsake sleeve comprising the steps of forming a first pocket comprised of a left front panel and a left back panel;

forming a second pocket comprised of a right front panel and a right back panel;

forming a left closing flap which is connected to the left back panel;

forming a middle closing flap which is connected to the right back panel;

forming a right closing flap which is connected to the middle closing flap; and inserting a first portion of a keepsake into the first pocket and a second portion of the keepsake into the second pocket.

16. The method of claim 15 further wherein the keepsake is a greeting card and the first portion of the greeting card is a first panel of the greeting card and the second portion of the greeting card is a second panel of the greeting card.

17. A method of forming a keepsake sleeve comprising the steps of forming a first pocket comprised of a left front panel and a left back panel;

forming a second pocket comprised of a right front panel and a right back panel;

forming a left closing flap which is connected to the left back panel;

forming a middle closing flap which is connected to the right back panel;

forming a right closing flap which is connected to the middle closing flap;

wherein the left, middle, and right closing flaps each include a first hole and further comprising inserting the left closing flap in between the middle closing flap and the right closing flap; and inserting a first ring of a binder through first holes in the left, middle, and right closing flaps.

18. The method of claim 17 wherein the first holes of the left, middle and right closing flaps are aligned when the first ring is inserted through them.

19. The method of claim 18 wherein the left, middle, and right closing flaps each include second and third holes and further comprising inserting a second ring of a binder through second holes in the left, middle, and right closing flaps; and inserting a third ring of a binder through third holes in the left, middle, and right closing flaps.

20. The method of claim 19 wherein the second holes of the left, middle and right closing flaps are aligned when the second ring is inserted through them; and the third holes of the left, middle and right closing flaps are aligned when the third ring is inserted through them.

* * * * *